US010724331B2

(12) United States Patent
Brekke

(10) Patent No.: US 10,724,331 B2
(45) Date of Patent: Jul. 28, 2020

(54) SYSTEM AND METHOD FOR FRACTURING A WELL

(71) Applicant: Flowpro Well Technology A.S, Oslo (NO)

(72) Inventor: Kristian Brekke, Oslo (NO)

(73) Assignee: Flowpro Well Technology a.s, Oslo (NO)

( * ) Notice: Subject to any disclaimer, the term of this patent is extended or adjusted under 35 U.S.C. 154(b) by 0 days.

(21) Appl. No.: 14/549,035

(22) Filed: Nov. 20, 2014

(65) Prior Publication Data

US 2015/0075808 A1 Mar. 19, 2015

Related U.S. Application Data

(63) Continuation of application No. 13/425,386, filed on Mar. 20, 2012, now Pat. No. 8,919,434.

(51) Int. Cl.

| | |
|---|---|
| ***E21B 34/06*** | (2006.01) |
| ***E21B 43/26*** | (2006.01) |
| ***E21B 34/14*** | (2006.01) |
| ***E21B 34/00*** | (2006.01) |

(52) U.S. Cl.

CPC ..... *E21B 34/063* (2013.01); *E21B 34/14* (2013.01); *E21B 43/26* (2013.01); *E21B 2034/007* (2013.01)

(58) Field of Classification Search

CPC ..... E21B 43/26; E21B 2034/007; E21B 34/14
See application file for complete search history.

(56) References Cited

U.S. PATENT DOCUMENTS

| | | | | | |
|---|---|---|---|---|---|
| 2,409,811 | A * | 10/1946 | Taylor, Jr. | E21B 23/06 | 166/125 |
| 2,923,562 | A * | 2/1960 | Bagnell | E21B 17/07 | 166/237 |
| 2,978,032 | A * | 4/1961 | Hanna | E21B 7/061 | 166/117.5 |
| 3,216,504 | A * | 11/1965 | Roark | E21B 33/12 | 166/181 |
| 3,845,819 | A * | 11/1974 | Mourlevat | E21B 43/10 | 166/239 |
| 3,966,236 | A * | 6/1976 | Vann | E21B 17/046 | 285/39 |
| 4,018,284 | A * | 4/1977 | Perkins | E21B 43/045 | 166/205 |
| 7,490,669 | B2 * | 2/2009 | Walker et al. | | 166/313 |
| 7,802,627 | B2 * | 9/2010 | Hofman et al. | | 166/386 |
| 8,356,671 | B2 * | 1/2013 | Guillory et al. | | 166/318 |

(Continued)

*Primary Examiner* — Jennifer H Gay
(74) *Attorney, Agent, or Firm* — Spradley PLLC; Michael Spradley

(57) ABSTRACT

A system and method for fracturing a well can comprise a base pipe comprising an insert port capable of housing a stop ball partially within the chamber of it, and a sliding sleeve. The sliding sleeve can comprise a first sleeve with an in inner surface. That inner surface can comprise a void. The first sleeve can be maneuverable into two positions. In the first position, the void can rest on a surface of the base pipe not comprising an insert port. Such positioning can prevent a stop ball from exiting the chamber of the base pipe. In the second position, the void can rest over an insert port. Such positioning can allow the stop ball to the chamber of the base pipe and to enter the void.

14 Claims, 9 Drawing Sheets

(56) References Cited

U.S. PATENT DOCUMENTS

| | | | | |
|---|---|---|---|---|
| 8,540,019 | B2 * | 9/2013 | Hofman et al. | 166/177.5 |
| 8,919,434 | B2 * | 12/2014 | Brekke | 166/177.5 |
| 2004/0163820 | A1 * | 8/2004 | Bishop et al. | 166/373 |
| 2006/0213670 | A1 * | 9/2006 | Bishop et al. | 166/386 |
| 2007/0084605 | A1 * | 4/2007 | Walker et al. | 166/313 |
| 2007/0204995 | A1 * | 9/2007 | Hofman et al. | 166/308.1 |
| 2011/0100643 | A1 * | 5/2011 | Themig et al. | 166/373 |
| 2011/0240301 | A1 * | 10/2011 | Robison et al. | 166/334.1 |
| 2011/0240311 | A1 * | 10/2011 | Robison et al. | 166/373 |
| 2011/0315390 | A1 * | 12/2011 | Guillory et al. | 166/329 |
| 2012/0097397 | A1 * | 4/2012 | Hofman et al. | 166/308.1 |
| 2012/0097398 | A1 * | 4/2012 | Ravensbergen et al. | 166/308.1 |
| 2012/0111574 | A1 * | 5/2012 | Desranleau et al. | 166/373 |
| 2012/0305265 | A1 * | 12/2012 | Garcia et al. | 166/373 |
| 2013/0168099 | A1 * | 7/2013 | Themig | 166/308.1 |
| 2013/0220603 | A1 * | 8/2013 | Robison et al. | 166/250.04 |
| 2013/0248189 | A1 * | 9/2013 | Brekke | 166/308.1 |
| 2013/0248190 | A1 * | 9/2013 | Brekke | 166/308.1 |
| 2014/0014347 | A1 * | 1/2014 | Adam et al. | 166/308.1 |
| 2014/0034294 | A1 * | 2/2014 | Hofman et al. | 166/177.5 |
| 2014/0083680 | A1 * | 3/2014 | Brekke | 166/250.01 |
| 2015/0075808 | A1 * | 3/2015 | Brekke | 166/373 |
| 2016/0061012 | A1 * | 3/2016 | Zimmerman, Jr. | E21B 43/121 166/329 |
| 2018/0038201 | A1 * | 2/2018 | Evans | E21B 23/006 |

* cited by examiner

SYSTEM AND METHOD FOR FRACTURING A WELL

PRIORITY

This application is a continuation application of utility application Ser. No. 13/425,386 filed Mar. 20, 2012.

BACKGROUND

This disclosure relates to a fracturing system and method for acquiring oil and gas.

The demand for natural gas and oil has significantly grown over the years making low productivity oil and gas reservoirs economically feasible, where hydraulic fracturing plays an important part in these energy productions throughout the world. For several decades different technology has been used to enhance methods for producing resources from oil and gas wells. Long horizontal wellbores with multiple fractures is one commonly used process to enhance extraction of oil and gas from wells. This process starts after a well has been drilled and the completion has been installed in the wellbore. Multi-stage hydraulic fracturing is a method that involves pumping large amounts of pressurized water or gel, a proppant and/or other chemicals into the wellbore to create discrete multiple fractures into the reservoir along the wellbore.

One of the technologically advanced methods being used today is simultaneous proppant fracturing of up to thirty fractures in one pumping operation. This method involves usage of proppant to prevent fractures from closing. However, this practice can usually cause an uneven distribution of proppant between the fractures, which will reduce the efficiency of the fracture system. As a result, this practice can also cause fractures to propagate in areas that are out of the target reservoir. Thus, such method can be inefficient and unsafe.

Additionally, proppant fracturing usually involves multiple steps and requires several tools in order to be performed successfully. Such practice that will allow even distribution of proppant between fractures highly depends on setting, plugs between the fracture stages or using frac balls of increasing sizes. In these methods, plugs are either set after each fracture has been perforated and pumped, or frac balls are dropped from the surface to successively open fracturing valves placed along the well. For each stage, balls of different diameters are dropped into the well corresponding to a specific fracturing valve's seat. At a point in the well, the ball will no longer pass through due to a decrease in well diameter. Once the ball is in place, fracturing can take place. After fracturing, the plugs must be drilled out and the balls must be recovered. With each fracturing stage while setting plugs, much time and energy is expended in tripping out of the hole between the stages and drilling out the plugs. Moreover, land-based rigs are usually rented per day basis, and so any delays can be quite expensive. Also, only about 12 different fracture stages are possible with the ball method before a restriction in flow area due to small ball diameter, which makes fracturing difficult due to large pressure losses.

As such it would be useful to have an improved system and method for fracturing oil and gas wells.

SUMMARY

This disclosure relates to an improved system and method for fracturing a well. In one embodiment, the system can comprise a base pipe comprising an insert port capable of housing a stop ball partially within the chamber of the pipe and a sliding sleeve. The sliding sleeve can comprise a first sleeve with an in inner surface. That inner surface can comprise a void. The first sleeve can be maneuverable into two positions. In the first position, the void can rest on a surface of the base pipe not comprising an insert port. Such positioning can prevent a stop ball from exiting the chamber of the base pipe. In the second position, the void can rest over the insert port. Such positioning can allow the stop ball into the chamber of said base pipe and to enter the void.

In another embodiment, the method can comprise connecting a base pipe within a pipe string. The base pipe can comprise an insert port capable of housing a stop ball, with the stop ball partially within the chamber of the base pipe. The method can also include the step of actuating a sliding sleeve from a first position to a second position. The sliding sleeve can comprise a first sleeve that has an in inner surface with a void. In the first position, the void can rest on a surface of said base pipe not comprising said insert port, preventing said stop ball from exiting the chamber of said base pipe. In the second position, the void can rest over the insert port. Such positioning can allow the stop ball to exit the chamber of said base pipe, to enter said void.

DETAILED DESCRIPTION

Described herein is an improved fracturing system and method for acquiring oil and gas. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1B:
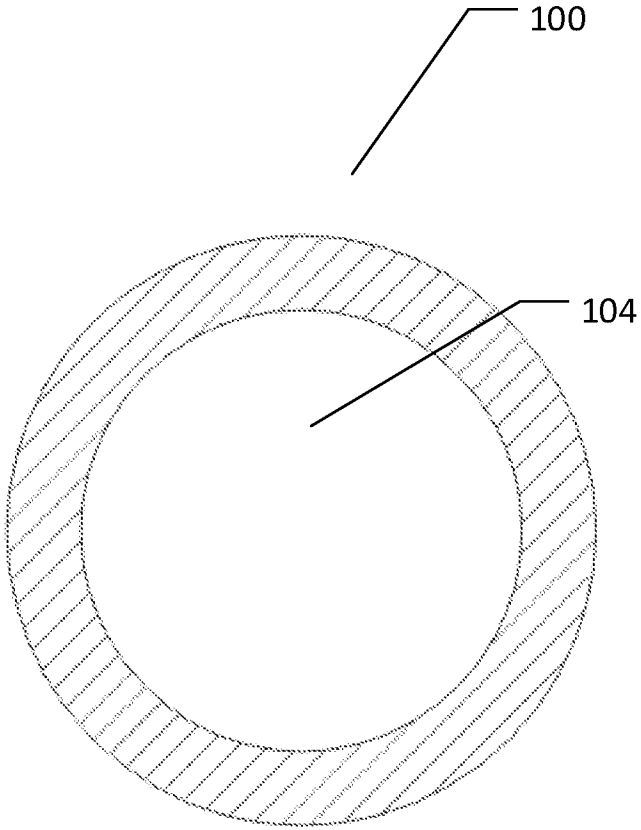
FIG. 1B illustrates a cross-sectional view of a base pipe.
Figure 1A:
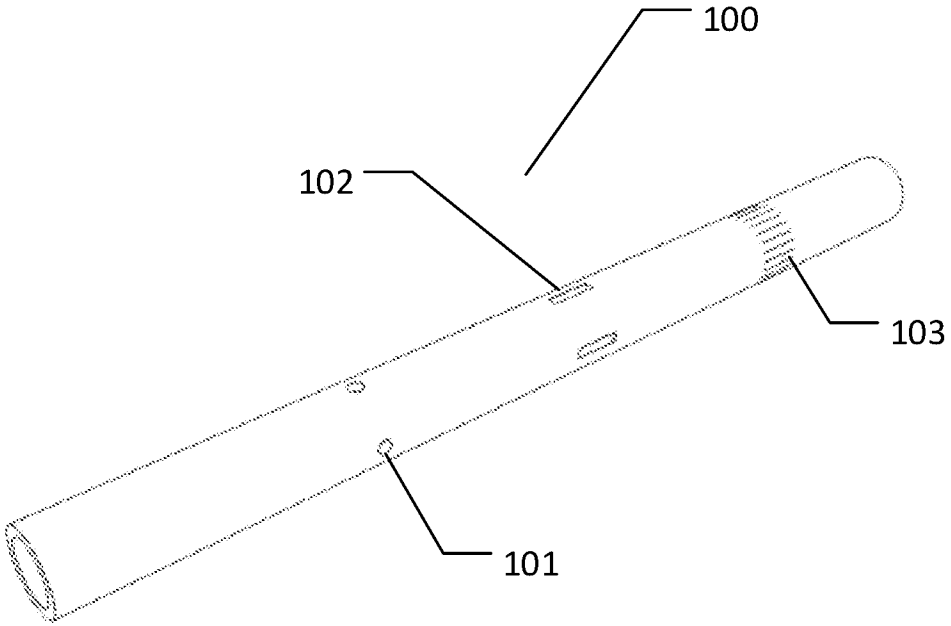
FIG. 1A illustrates a side view of a base pipe.

FIG. 1A illustrates a side view of a base pipe 100. Base pipe 100 can be connected as a portion of a pipe string. In one embodiment, base pipe 100 can be a cylindrical material that can comprise different wall openings and/or slots. Base pipe 100 wall openings can comprise insert port 101, fracturing port 102, and/or production port 103. Insert port 101 can be made of one or more small openings in a base pipe 100. Fracturing port 102 can also be made of one or more openings. Further, production port 103 can be a plurality of openings in base pipe 100.

Figure 1C:
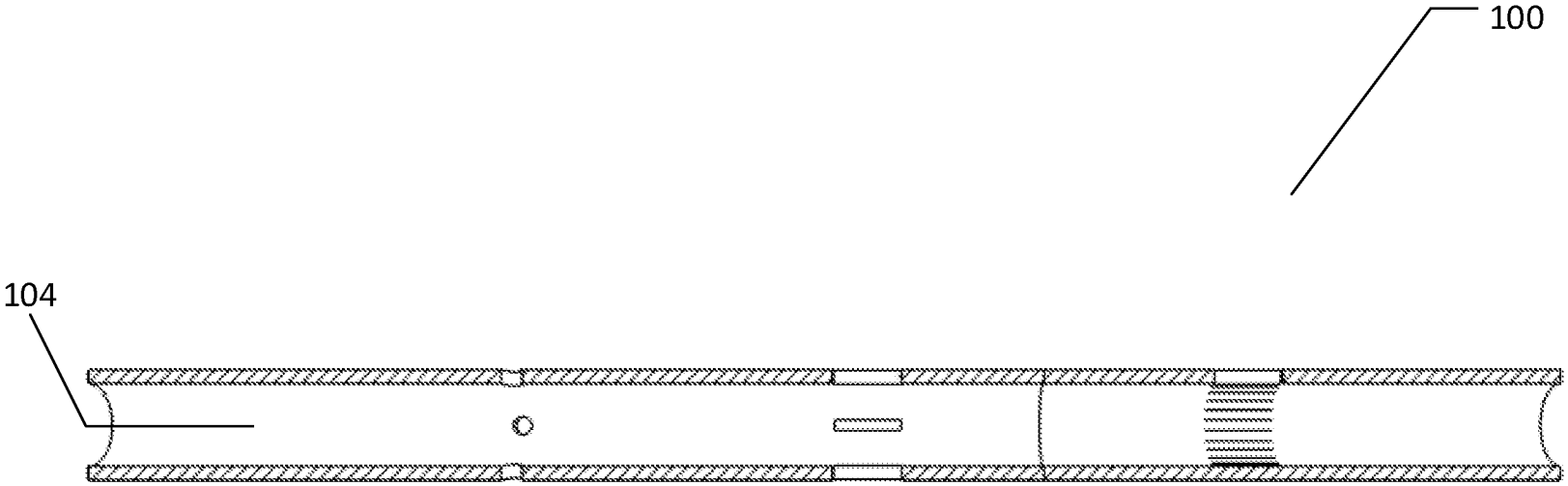
FIG. 1C illustrates a cross sectional view of a base pipe.

FIG. 1B illustrates a front view of base pipe 100. Base pipe 100 can further comprise a chamber 104. Chamber 104 can be a cylindrical opening or a space created inside base pipe 100. As such chamber 104 can be an opening that can allow material, such as fracturing fluid or hydrocarbons to pass through. FIG. 1C illustrates a cross sectional view of a base pipe 100. Each wall opening discussed above can be circularly placed around base pipe 100.

Figure 2B:
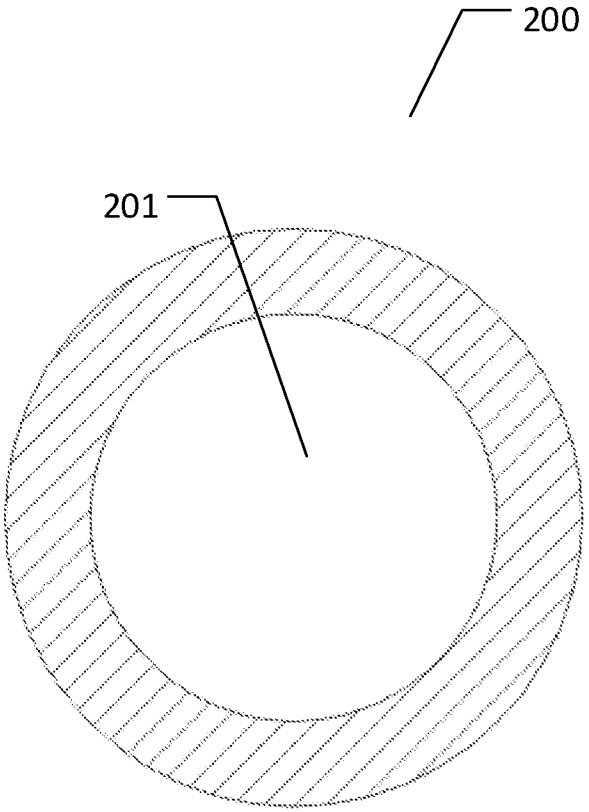
FIG. 2B illustrates a cross-sectional view of a sliding sleeve.
Figure 2A:
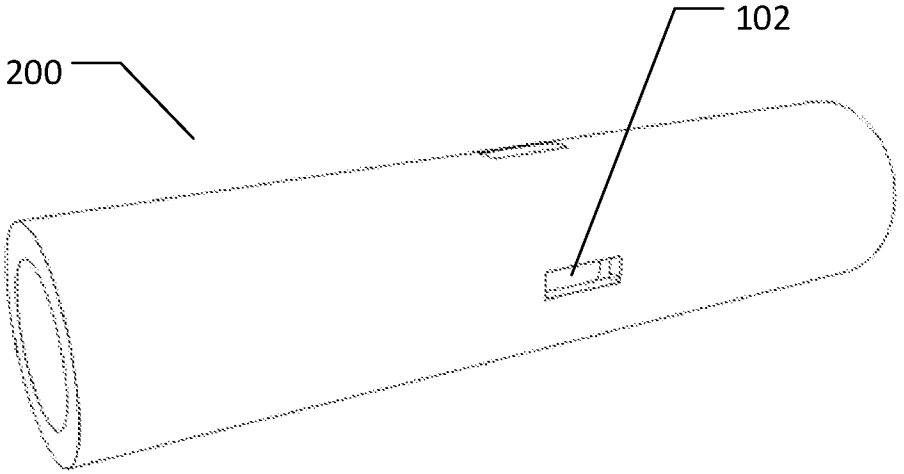
FIG. 2A illustrates a sliding sleeve.

FIG. 2A illustrates a sliding sleeve 200. In one embodiment, sliding sleeve 200 can be a cylindrical tube that can comprise fracturing port 102. Thus, fracturing port 102 can have a first portion within base pipe 101 and a second portion within sliding sleeve 200. FIG. 2B illustrates a front view of a sliding sleeve 200. Sliding sleeve 200 can further comprise an outer chamber 201. In one embodiment, outer chamber 201 can be an opening larger than chamber 104. As such, outer chamber 201 can be large enough to house base pipe 100.

Figure 2C:
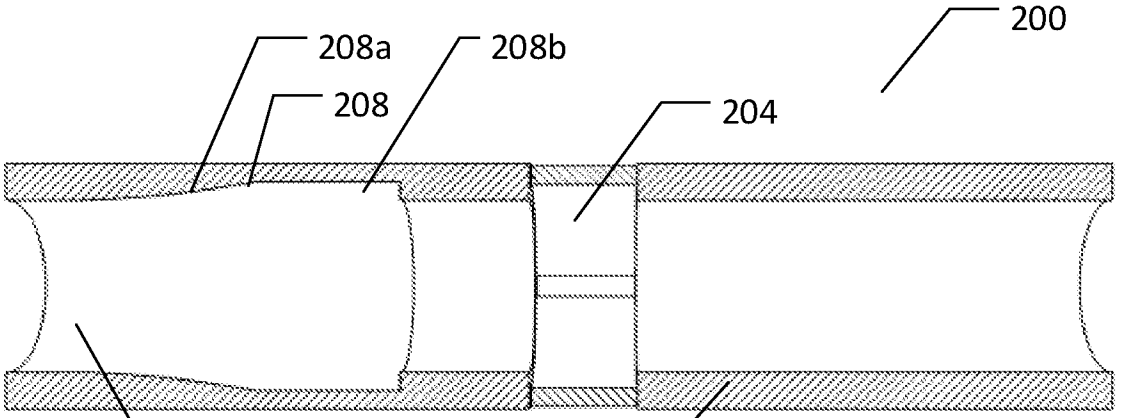
FIG. 2C illustrates a cross sectional view of a sliding sleeve.

FIG. 2C illustrates a cross sectional view of a sliding sleeve 200. Sliding sleeve 200 can comprise a first sleeve 202 and a second sleeve 203. First sleeve 202 and second sleeve 203 can be attached through one or more curved sheets 204 with the spaces between each curved sheet 204 defining a portion of fracturing port 102. Inner surface of first sleeve 202 can have a bottleneck void, or any other void within the inner surface. The void can extend radially around the complete inner diameter of base pipe 101, partially around the inner diameter, or locally. If completely around the inner diameter, the ends of inner surface can have a smaller diameter than the void.

Figure 2D:
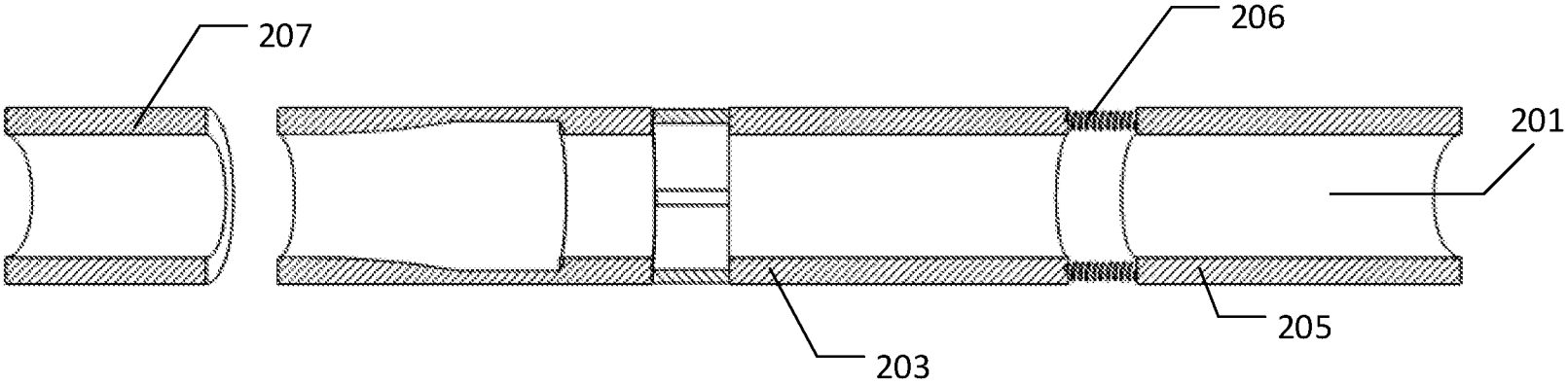
FIG. 2D illustrates a cross sectional view of a sliding sleeve.

FIG. 2D illustrates a cross sectional view of a sliding sleeve 200. Sliding sleeve 200 can further comprise a fixed sleeve 205, and actuator 206. In one embodiment, actuator 206 can be a biasing device. In such embodiment, biasing device can be a spring. In another embodiment, actuator can be bidirectional and/or motorized. In one embodiment, second sleeve 203 of sliding sleeve 200 can be attached to fixed sleeve 205 using actuator 206. In one embodiment, sliding sleeve 200 can be pulled towards fixed sleeve 205, thus compressing, or otherwise storing, load actuator 206 with potential energy. Later actuator 206 can be released, or otherwise instigated, pushing sliding sleeve 200 away from fixed sleeve 205.

Figure 3B:
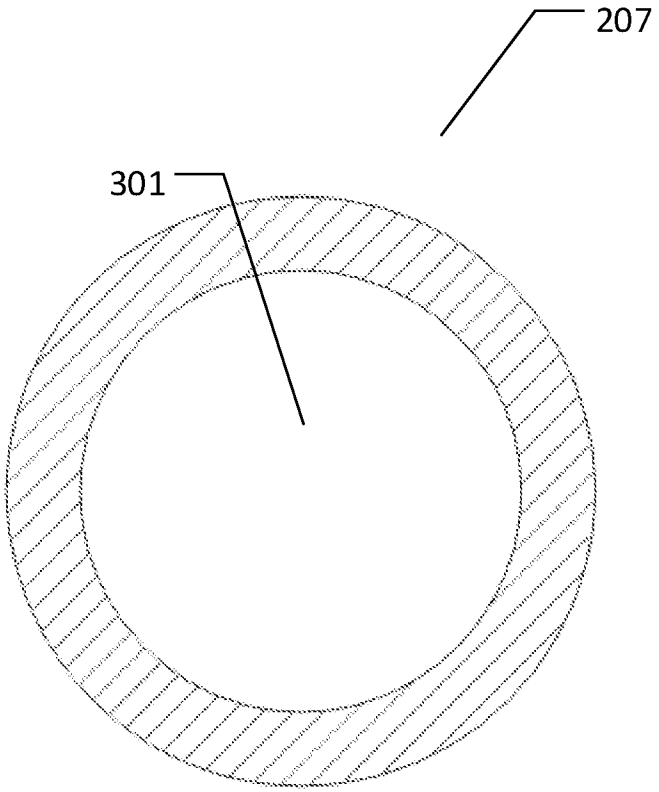
FIG. 3B illustrates a cross-sectional view of an outer ring.
Figure 3A:
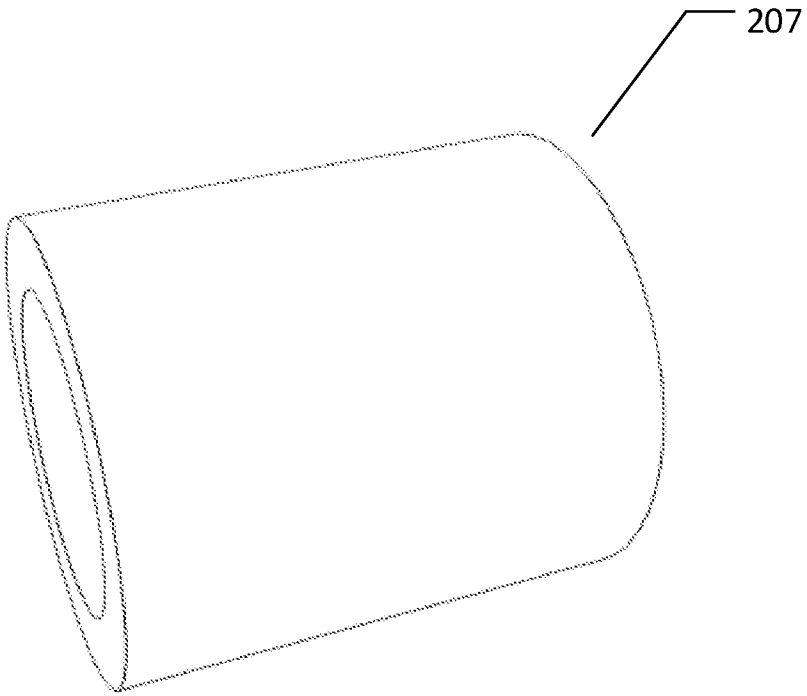
FIG. 3A illustrates a peripheral view of outer ring.

FIG. 3A illustrates a peripheral view of outer ring 207. In one embodiment, outer ring 207 can be a solid cylindrical tube forming a ring chamber 301, as seen in FIG. 3B. In one embodiment, outer ring 207 can be an enclosed solid material forming a cylindrical shape. Ring chamber 301 can be the space formed inside outer ring 207. Furthermore, ring chamber 301 can be large enough to slide over base pipe 100.

Figure 4A:
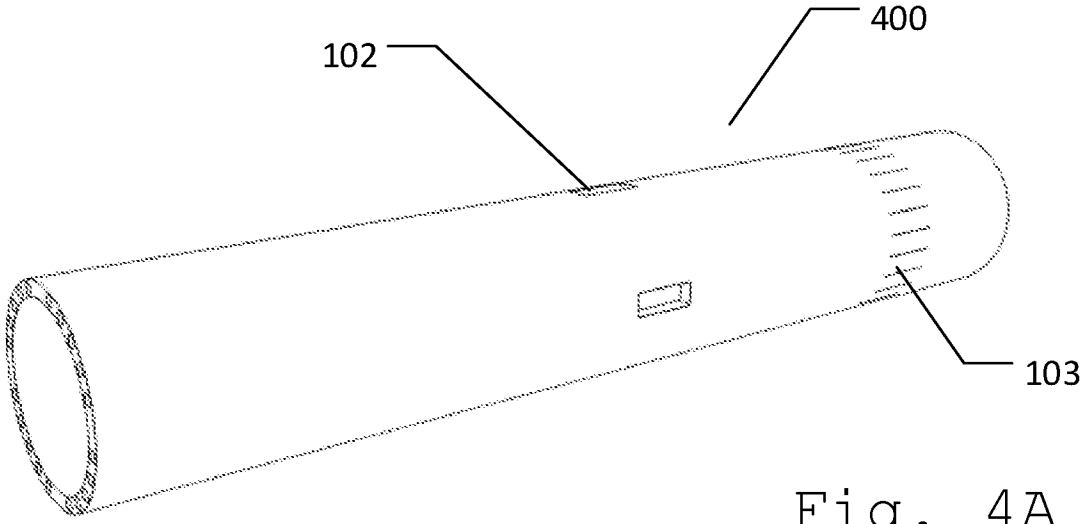
FIG. 4A illustrates a valve casing.
Figure 4B:
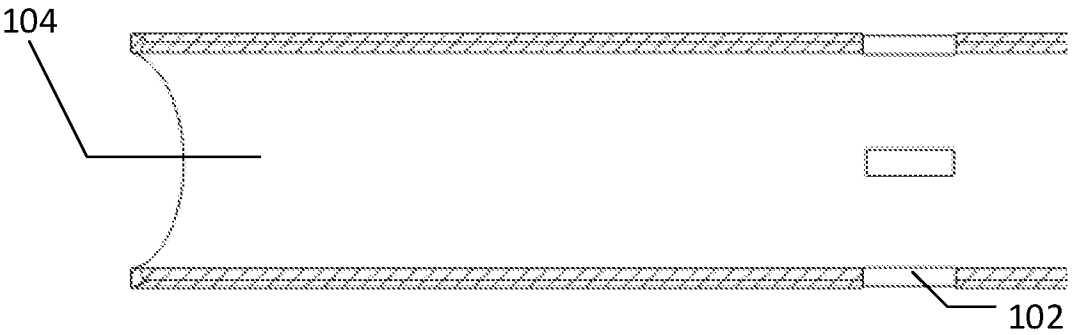
FIG. 4B illustrates a fracturing port of a valve casing.
Figure 4C:
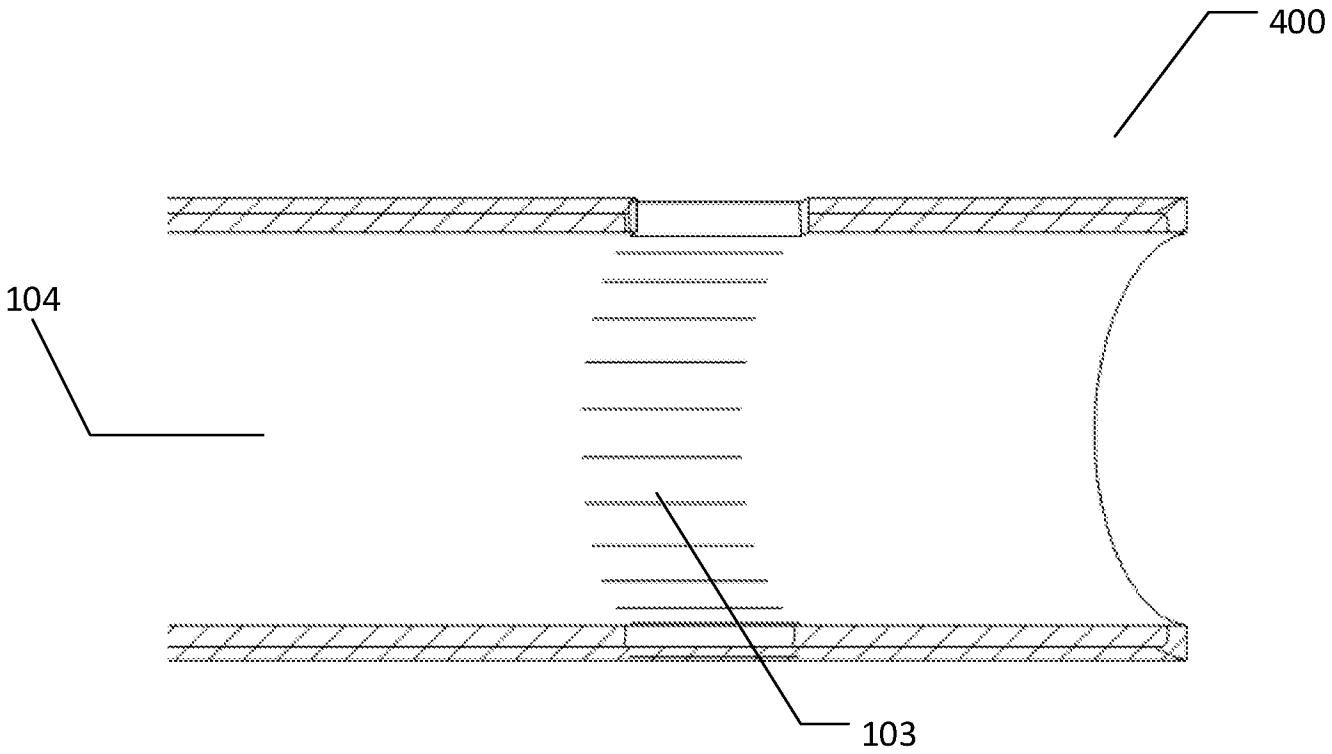
FIG. 4C illustrates a production port of a valve casing.

FIG. 4A illustrates a valve casing 400. In one embodiment, valve casing 400 can be a cylindrical material, which can comprise fracturing port 102, and production port 103. FIG. 4B illustrates fracturing port 102 of valve casing 400. In one embodiment, fracturing port 102 can be a plurality of openings circularly placed around valve casing 400, as seen in FIG. 4B. FIG. 4C illustrates production port 103 of valve casing 400. Furthermore, production port 103 can be one or more openings placed around valve casing 400, as seen in FIG. 4C.

Figure 5:
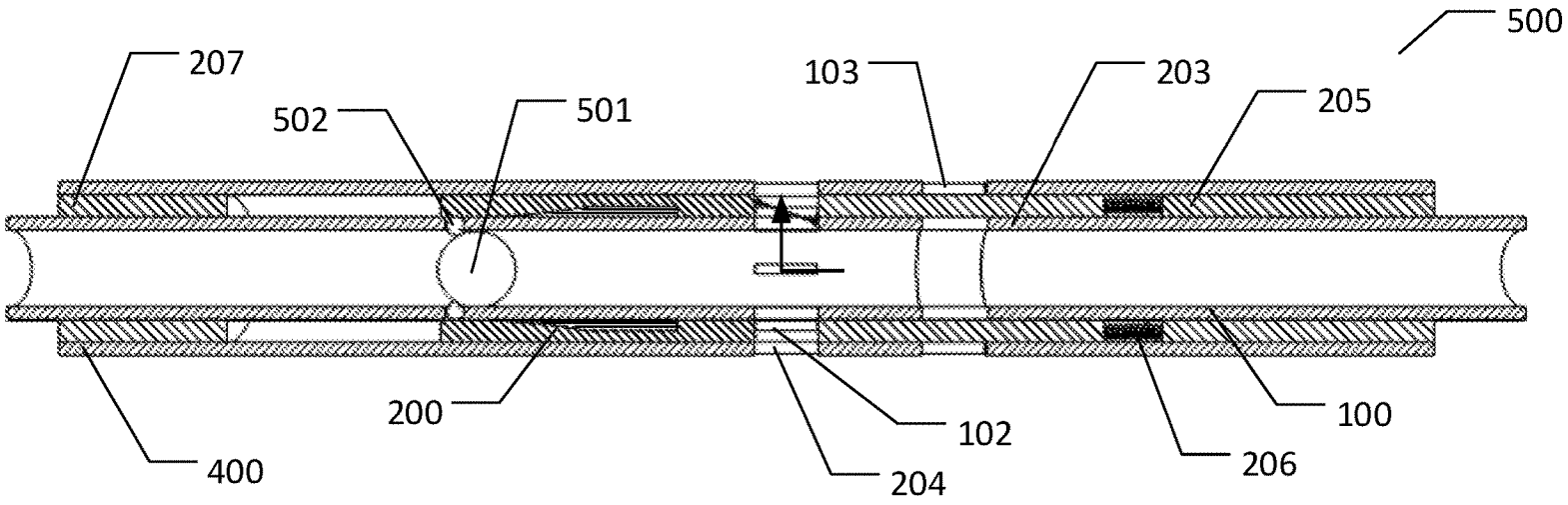
FIG. 5 illustrates a fracturing valve in fracturing mode.

FIG. 5 illustrates a fracturing valve 500 in fracturing mode. In one embodiment, fracturing valve 500 can comprise base pipe 100, sliding sleeve 200, outer ring 207, and/or valve casing 400. In such embodiment, base pipe 100 can be an innermost layer of fracturing valve 500. A middle layer around base pipe 100 can comprise outer ring 207 fixed to base pipe 100 and sliding sleeve 200, where fixed sleeve 205 is fixed to base pipe 100. Fracturing valve 500 can comprise valve casing 400 as an outer later. Valve casing 400 can, in one embodiment, connect to outer ring 207 and fixed sleeve 205. In a fracturing position, fracturing port 102 can be aligned and open, due to the relative position of base pipe 100 and sliding sleeve 200.

Fracturing valve 500 can further comprise a frac ball 501 and one or more stop balls 502. In one embodiment, stop ball 502 can rest in insert port 101. At a fracturing state, actuator 206 can be in a closed state, pushing stop ball 502 partially into chamber 104. In such state, frac ball 501 can be released from the surface and down the well. Frac ball 501 will be halted at insert port 101 by any protruding stop balls 502 while fracturing valve 500 is in fracturing mode. As such, the protruding portion of stop ball 502 can halt frac ball 501. In this state, fracturing port 102 will be open, allowing flow of proppant from chamber 104 through fracturing port 102 and into a formation, thereby allowing fracturing to take place.

Figure 6:
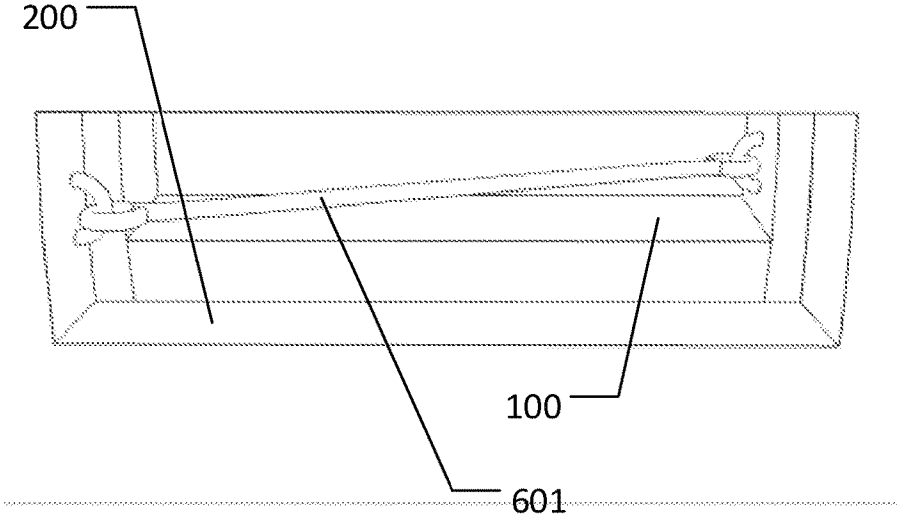
FIG. 6 illustrates an impedance device in between fracturing port.

FIG. 6 illustrates an impedance device in between fracturing port. An impedance device can counteract actuator 206, in an embodiment where actuator 206 is a biasing device, such as a spring. In one embodiment, an erosion device, in the form of a string 601, can be an impedance device. String 601 can connect sliding sleeve 200 with base pipe 100. While intact, string 601 can prevent actuator 206 from releasing. Once the string 601 is broken, actuator 206 can push sliding sleeve 200. One method of breaking string 601 can be by pushing a corrosive material reactive with string through fracturing port, as corrosive material can deteriorate string 601 until actuator 206 can overcome its impedance.

Figure 7:
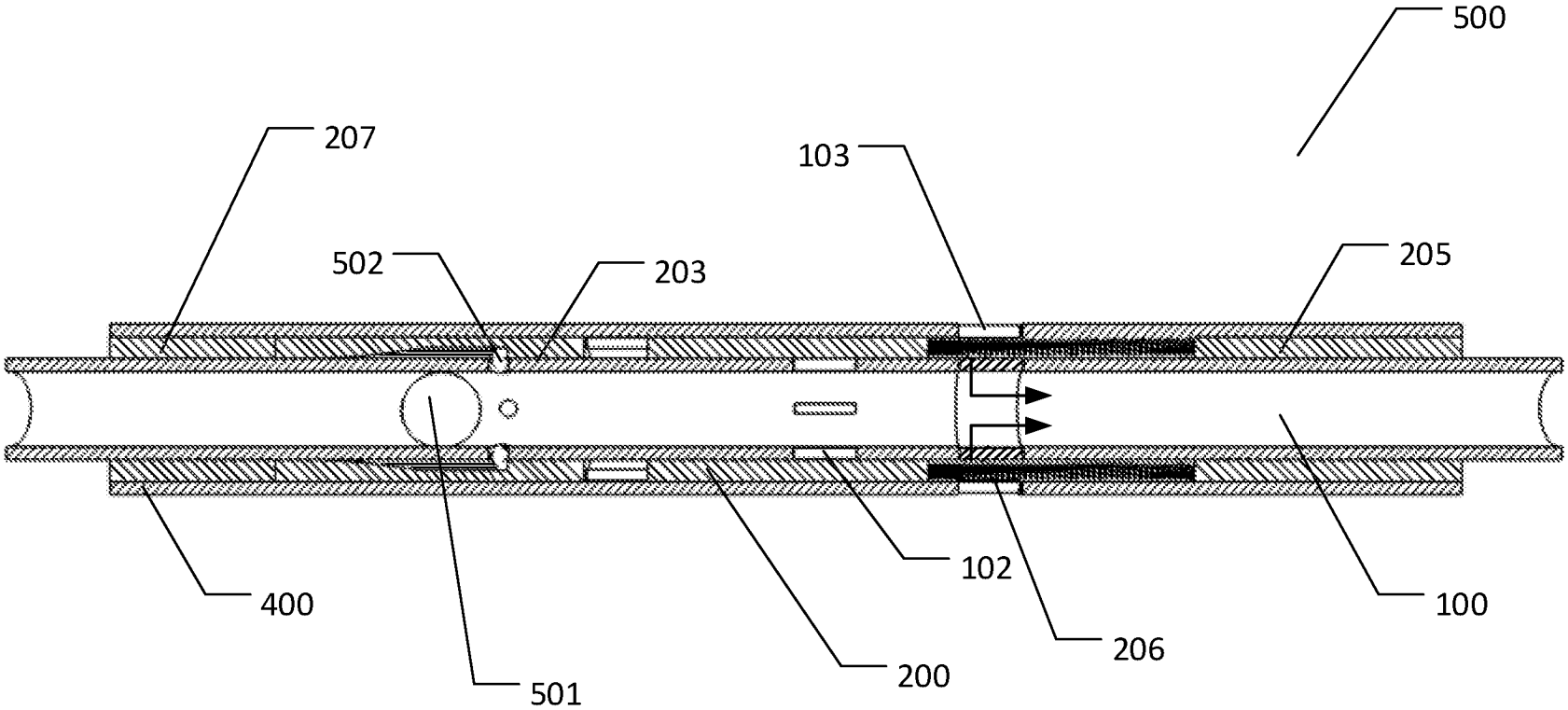
FIG. 7 illustrates fracturing valve in production mode.

FIG. 7 illustrates fracturing valve 500 in production mode. As sliding sleeve 200 is pushed towards outer ring 207 by actuator 206, fracturing port 102 can close and production port 103 can open. Concurrently, frac ball 501 can push stop balls 502 back into the inner end of first sleeve 202, which can further allow frac ball 501 to slide through base pipe 101 to another fracturing valve 500. Once production port 103 is opened, extraction of oil and gas can start. In one embodiment, production ports 103 can have a check valve to allow fracturing to continue downstream without pushing fracturing fluid through the production port 103.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A well fracturing system, the system comprising:

a base pipe comprising an insert port capable of housing a stop ball and a second insert port, said insert port passing through a wall of said base pipe;

a sliding sleeve comprising a first sleeve, said first sleeve comprising an inner surface, said inner surface comprising a void, wherein said void extends around the inner diameter of said base pipe, said first sleeve maneuverable into a first position in which said stop ball is partially within a chamber of said base pipe, said stop ball prevented from exiting said chamber of said base pipe by said void being adjacent a surface of said base pipe not including said insert port or said second insert port; and a second position in which said stop ball is capable of exiting said chamber of said base pipe to enter said void when said void is adjacent said insert port; and an actuator that actuates said sliding sleeve between said first position and said second position, such that while said actuator is in a closed state, said sliding sleeve is in said first position and while said actuator is in an open state, said sliding sleeve is in said second position.

2. The well fracturing system of claim 1 further comprising:

a fixed sleeve fixed around said base pipe near a first side of said sliding sleeve, wherein said actuator connects said fixed sleeve to said sliding sleeve, said actuator capable of moving said sliding sleeve from said first position to said second position.

3. The well fracturing system of claim 2, wherein said actuator is a spring.

4. The well fracturing system of claim 2 further comprising an impedance device that impedes said actuator from actuating.

5. The well fracturing system of claim 2 further comprising an outer ring fixed around said base pipe near said first side of said sliding sleeve.

6. The well fracturing system of claim 1, wherein said insert port is narrower near said chamber of said base pipe, to prevent said stop ball from completely entering said chamber.

7. The well fracturing system of claim 1 further comprising a one-way valve at a production port to prevent fracturing fluid from exiting said base pipe at said production port.

8. A well fracturing system, the system comprising:

a base pipe comprising an insert port capable of housing a stop ball and a second insert port, said insert port passing through a wall of said base pipe;

a sliding sleeve comprising a first sleeve, said first sleeve comprising an inner surface, said inner surface comprising a void and a second void, said first sleeve maneuverable into a first position in which said stop ball is partially within a chamber of said base pipe, said stop ball prevented from exiting said chamber of said base pipe by said void being adjacent a surface of said base pipe not including said insert port and said second void being adjacent said surface of said base pipe not including said second insert port; and a second position in which said stop ball is capable of exiting said chamber of said base pipe to enter said void when said void is adjacent said insert port, further said second position wherein said second void is adjacent said second insert port; and an actuator that actuates said sliding sleeve between said first position and said second position, such that while said actuator is in a closed state, said sliding sleeve is in said first position and while said actuator is in an open state, said sliding slave is in said second position.

9. The well fracturing system of claim 8 further comprising:

a fixed sleeve fixed around said base pipe near a first side of said sliding sleeve, wherein said actuator connects said fixed sleeve to said sliding sleeve, said actuator capable of moving said sliding sleeve from said first position to said second position.

10. The well fracturing system of claim 9, wherein said actuator is a spring.

11. The well fracturing system of claim 9 further comprising an impedance device that impedes said actuator from actuating.

12. The well fracturing system of claim 9 further comprising an outer ring fixed around said base pipe near a first side of said sliding sleeve.

13. The well fracturing system of claim 8, wherein said insert port is narrower near said chamber of said base pipe, to prevent said stop ball from completely entering said chamber.

14. The well fracturing system of claim 8 further comprising a one-way valve at a production port to prevent fracturing fluid from exiting said base pipe at said production port.

* * * * *